United States Patent [19]

Herr

[11] Patent Number: 4,869,362

[45] Date of Patent: Sep. 26, 1989

[54] POSITIVE SEAL PACKAGE

[76] Inventor: William A. Herr, 246 Blades Trail, Denver, N.C. 28037

[21] Appl. No.: 40,417

[22] Filed: Apr. 20, 1987

[51] Int. Cl.[4] ..... B65D 85/00

[52] U.S. Cl. ..... 206/45.33; 53/468; 53/473; 206/45.34; 206/557; 206/813; 229/87 F

[58] Field of Search ..... 206/45.33, 471, 557, 206/525, 813, 497, 45.34; 229/87 F, 48 T; 53/427, 441, 442, 463, 478

[56] References Cited

U.S. PATENT DOCUMENTS

| | | | |
|---|---|---|---|
| 1,929,217 | 10/1933 | Rosen | 206/45.33 |
| 2,294,652 | 9/1942 | Blair | 206/45.33 |
| 2,565,976 | 8/1951 | Mayer et al. | 229/87 F |
| 2,668,403 | 2/1954 | Rumsey, Jr. | 206/45.33 |
| 2,808,192 | 10/1957 | Raisin | 206/45.34 |
| 2,874,890 | 2/1959 | Evanstein | 229/48 T |
| 3,027,997 | 4/1962 | Reifers | 206/45.33 |
| 3,050,402 | 8/1962 | Dreyfus et al. | 206/45.33 |
| 3,070,274 | 12/1962 | Elam | 229/48 T |
| 3,074,798 | 1/1963 | Palmer | 206/45.33 X |
| 3,589,510 | 6/1971 | Begnaud | 206/45.33 X |

*Primary Examiner*—Stephen Marcus
*Attorney, Agent, or Firm*—James B. Hinson

[57] ABSTRACT

The invention provides an improved package and packaging method for products that contain moisture. In the preferred embodiment, the product to be packaged is placed in a tray and the product and the tray are wrapped with a transparent film. The film is selectively affixed to at least a portion of the bottom of the tray using a heat-activated adhesive to form a leak-resistant package.

8 Claims, 1 Drawing Sheet

Fig. 1
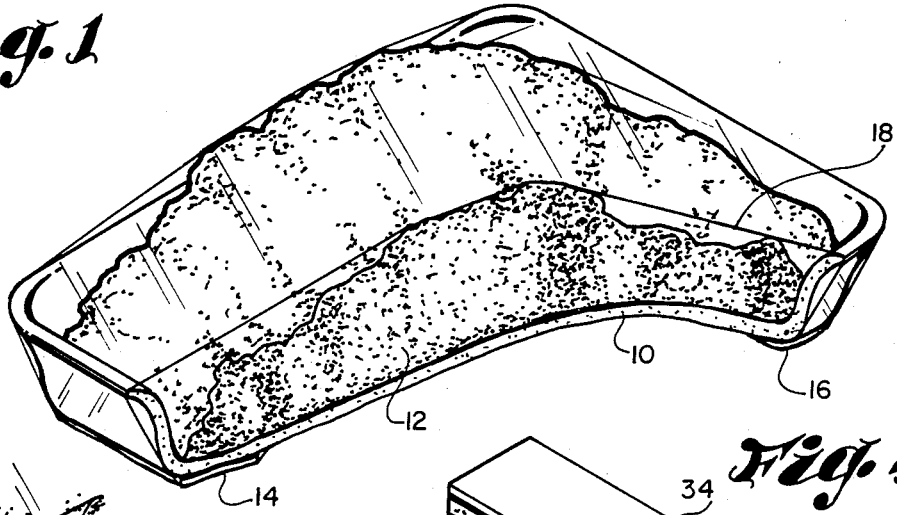
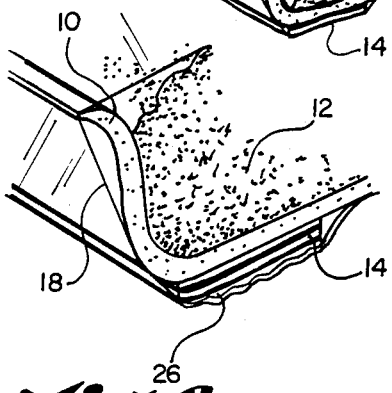
Fig. 3
Fig. 4
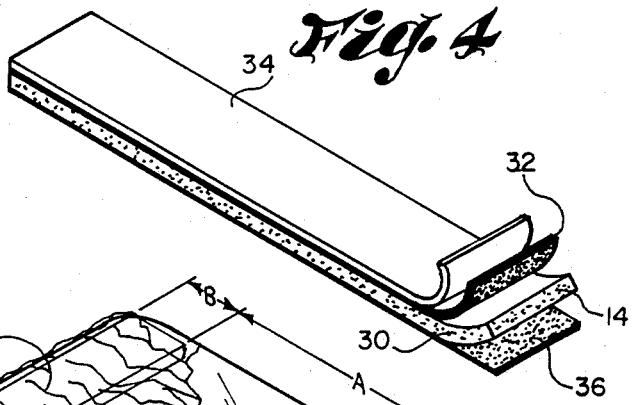
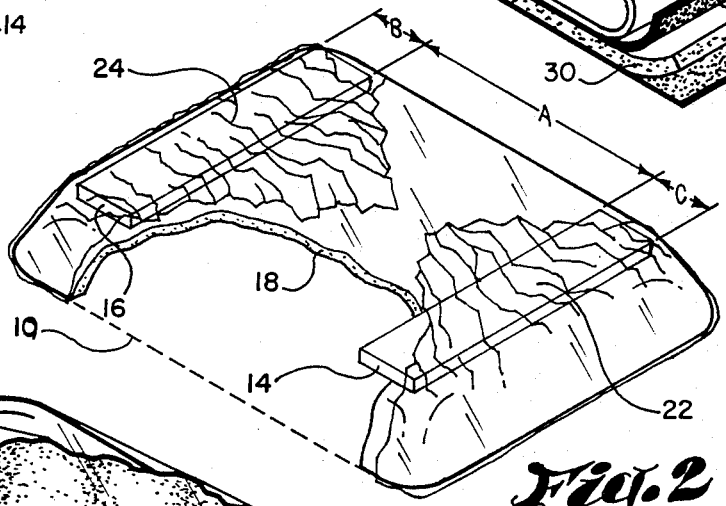
Fig. 2
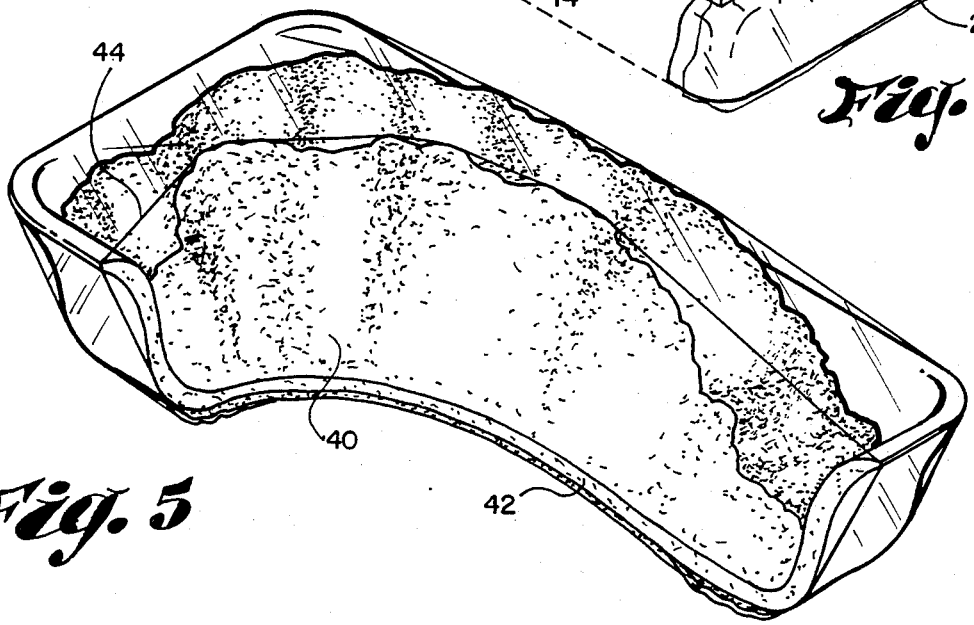
Fig. 5

POSITIVE SEAL PACKAGE

BACKGROUND OF THE INVENTION

1. Field of the Invention

The invention relates generally to packages and more specifically to packages and packaging methods in which a product supported in a tray is wrapped with a film which is selectively affixed to the tray using a heat activated adhesive.

2. Description of the Prior Art

In a typical prior art package and packaging technique the product is placed in a tray and covered with a plastic film such that the film totally encloses the tray and the product. Heat is applied to the bottom of the package. Portions of the film which overlap such that contact is established therebetween adhere to form a seal.

Such packaging techniques are widely used in the food industry to package food products which include moisture. Since the plastic film adheres to itself, a relatively leak-proof seal is formed in areas where the film overlaps without wrinkles or excessive overlaping layers. Wrinkles and excessive overlaping layers adversely effect the sealing characteristics of the film resulting in an increase in the number of packages which develop leaks.

Areas forming a good seal are usually concentrated in the central portion of the package. Areas near or adjacent the ends usually include excessive overlaping layers and wrinkles. Wrinkles and excessive overlaping layers change the sealing characteristics as a result of the formation of regions where no contact is established between overlaping layers of the film. Passages are formed along the wrinkles and between excessive overlaping layers which may extend from the interior of the package to the exterior of the package.

The inside surface of the film is typically treated to prevent the formation of water droplets. Condensation forming on the inside surface of the film tends to flow along this surface and through the passageways, discussed above. As a result, the package leaks and must be removed from the shelf before it is sold. Such leaks are particularly troublesome when food products such as fresh meats, poultry and seafood are to be packaged due to the high moisture content of these products.

SUMMARY OF THE INVENTION

In one embodiment of the invention a strip of double sided adhesive tape is affixed to the bottom surface of the tray adjacent the edges thereof using a conventional pressure sensitive adhesive. The exposed surface of the tape includes a layer of a heat activated adhesive. The product to be packaged is placed in the tray and the film is folded around the sides, around the ends and underneath the tray to totally enclose the tray. Folding the film underneath the tray in this manner tends to form areas of multiple layer film and wrinkles. These multiple layers of film and wrinkles tend to be concentrated in regions of the bottom adjacent to or near the ends of the tray.

After the sides and ends of the film have been folded underneath the package heat is applied to its under surface causing the film to adhere to itself where it overlaps and to the tape as the adhesive is activated. Along the central portion of the bottom of the package the film seals to itself and forms a relatively leak proof seal in a conventional fashion. Other portions of the film are sealed to the tray by the heat activated adhesive. Areas where the film overlies the heat activated adhesive and areas where the film overlaps are collectively referred to as the sealing zone.

In a second embodiment of the invention, the product to be packaged is placed in a tray and the entire bottom surface of the tray is coated with a heat-activated adhesive. A film is placed over the product and folded underneath the tray to totally enclose the tray. Wrinkles and excessive overlapping layers are formed, as discussed above. Heat is applied causing the film to seal to the package along substantially the entire sealing zone as the adhesive is activated, thereby forming an essentially leak proof package.

In all embodiments of the invention, the film tends to be attracted by the adhesive when in the activated state. Additionally, the adhesive tends to flow, changing the contour of the adhesive layer to fill, at least a portion of, any space between the film and the tray. This significantly reduces the number of passageways and forms a highly leak-resistant package.

In practicing the invention, the product may be placed in the tray, wrapped with film and heated to produce the seal using currently available equipment and materials. For example, the film may be polyvinylchloride. The adhesive tape and the adhesive layer may be applied to the bottom of the tray using any convenient technique.

OBJECTS OF THE INVENTION

It is the principal objective of the invention to provide an improved leak-resistant package.

It is another object of the invention to provide a leak-resistant package using currently available materials.

It is another object of the invention to provide a packaging technique using a film to cover the product in which the number of passageways from the interior to the exterior of the package are reduced.

It is another object of the invention to provide a film packaging technique in which a heat-activated adhesive is used to reduce the number of passageways along wrinkles and between excessive layers of the film.

DESCRIPTION OF THE DRAWINGS

FIG. 1 is a drawing partially in cross section illustrating a first embodiment of the invention.

FIG. 2 is a bottom view of the embodiment illustrated in FIG. 1.

FIG. 3 is partial cross-sectional view of a portion of the package.

FIG. 4 is a drawing illustrating the adhesive tape used in the invention.

FIG. 5 is a drawing in partial cross-section illustrating a second embodiment of the invention.

DETAILED DESCRIPTION

Referring now to FIG. 1, which is a drawing illustrating a product packaged in accordance with the invention, a conventional polyurethane tray 10 of the type frequently used to package fresh meats, poultry and seafood, is used to support a product 12. The tray includes a substantially flat bottom member and a perimetrical side wall surrounding and joined to the bottom member. Two strips of heat-activated adhesive tape 14 and 16 are affixed to the bottom surface of the tray 10 in areas adjacent opposed ends of the tray 10. A thin transparent plastic film 18 extends over the top surface of the product 12 and around the edges of the tray 10. The film is folded underneath to totally enclose the product 12 and the tray 10.

As the film 18 is folded underneath the tray 10, it extends over the bottom of the tray 12 and overlaps making relatively wrinkle-free contact with itself and the bottom of the tray in the central portion of the tray, identified by the letter "A" in FIG. 2. This region also tends to be relatively free of excessive overlapping regions, i.e. regions of more than two overlapping layers. However, as the ends of the film 18 are folded underneath the tray 10, multi-layers, wrinkles and excessive overlapping regions develop, which are typically concentrated near the opposed ends of the tray 10 as generally indicated at reference numerals 22 and 24 of FIG. 2.

After the film 18 has been folded underneath the tray, along both its sides and ends, heat is applied to the bottom of the package causing the film 18 to adhere to itself, forming a relatively leak-proof seal along the central portion A of the package. Adjacent the ends of the package, portions of the film 18 in contact with itself seal together. Additionally portions of the film 18 in contact with the heat-activated adhesive on the outer surface of the adhesive tape strips 14 and 16 are sealed to the tape forming a relatively leak-proof package. The surface of the adhesive tends to change contour to conform to the space between the film 18 and the surface of the adhesive tape reducing the number of passageways between the interior and the exterior of the package, further improving the seal. In summary, a highly leak-resistant seal is formed over the entire sealing zone.

In FIG. 2, the wrinkling of the film along the end portions is clearly illustrated. Additionally, the heat-activated adhesive tends to change in contour and fill in the irregular spaces between the film and the tape 14, as previously described and generally illustrated at reference numeral 26. The thermally activated adhesive may be BOSTIC THERMOGRIP #6370, for example.

The heat-activated adhesive tape 14 is illustrated in FIG. 4. Heat-activated adhesive tape strip 14 is also representative of the second strip of heat-activated adhesive tape 16. The tape 14 includes a suitable base member 30, which may be of paper or suitable plastic. The upper surface of the base 30 is coated with a layer of pressure sensitive adhesive 32. A temporary peel off protective layer of paper or other suitable material 34 is attached to the upper surface. A suitable heat-activated adhesive layer 36 is formed on the lower surface of the tape stock 30. A suitable tape can be made using currently available materials.

In practicing the invention, the product 12 is placed in the tray 10 using conventional packaging techniques. The upper protective layer 34 is removed from two pieces of heat-activated adhesive tape to expose the pressure sensitive adhesive. The two strips of heat-activated adhesive tape 14 and 16 are then positioned in the proper relationship of the package 10 and suitable pressure is applied between the tapes 14 and 16 causing them to adhere to package 10. The plastic film 18 is then positioned around the product and sealed as previously described.

A second embodiment of the invention is illustrated in FIG. 5. In this embodiment, the product 40 to be packaged is placed in a tray 42. The bottom surface of the tray 42 is coated with a heat activated adhesive. A suitable plastic film 44 is positioned over the product 40 and folded underneath the package as previously discussed with respect to the embodiment illustrated in FIG. 1. Heat is applied to the bottom surface of the package causing the heat-activated adhesive to seal the film 44 to substantially all of the bottom surface of the tray 42, thereby forming a leak-resistant package. Sealing is further improved as the contour of the adhesive layer changes and tends to conform to the space between the film 44 and the tray 10. This results in a highly leak-resistant seal being formed across the entire sealing zone.

The package and packaging technique which is the subject of this invention may be implemented using a variety of commercially available components. If food products are to be packaged, it is obvious that all f the materials must be approved for use in food packaging and storage. Additionally, the heat-activated adhesive must have an activation temperature compatible with the film and the tray. More specifically, the activation temperature of the heat-activated adhesive must be so selected that the film and tray are not damaged in the sealing process.

SUMMARY OF THE ACHIEVEMENT OF THE OBJECTS OF THE INVENTION

From the foregoing, it is readily apparent that I have invented an improved leak-resistant package, particularly for a food product, using currently available materials; as well as a packaging technique using a film to cover the product in which the number of passageways from the interior to the exterior of the package are reduced, and in which a heat-activated adhesive is used to reduce the number of passageways along wrinkles and between excessive layers of the film.

What is claimed is:

1. A substantially leakproof package for a product containing a liquid, comprising:

(a) a tray for holding said product to be packaged, said tray including a substantially flat bottom portion surrounded by a perimetrical said wall to contain said product within the tray;

(b) a strip of tape having a layer of heat activated adhesive affixed to selected areas of said substantially flat bottom portion adjacent the junction of said bottom portion and said perimetrical side wall;

(c) a film sized to extend over said product and underneath said tray to enclose said product within said tray and to contact at least said selected areas of said bottom bearing said tape; whereby (d) upon selective application of heat to said package, said heat activated adhesive will be activated to seal said film to said selected areas of said substantially flat bottom portion and portions of said film will seal to each other to form a substantially leak-proof package.

2. A package in accordance with claim 1 wherein said tray is molded polyurethane.

3. A package in accordance with claim 2 wherein said film is polyvinylchloride.

4. A package in accordance with claim 3 wherein said tape is affixed to the bottom of said tray using a pressure activated adhesive.

5. A method of packaging a product which includes a liquid using a package which includes a tray having a substantially flat bottom and air upwardly extending perimetrical side wall which surrounds said product, and a film wrapper enclosing said product and tray comprising the steps of:

(a) placing said product in said tray;

(b) affixing a strip of tape having a layer of heat activated adhesive to said substantially flat bottom along at least opposed edges thereof;

(c) placing said film wrapper over said product such that said film wrapper extends underneath said tray, overlaps and contacts at least a portion of said layer of heat activated adhesive;

(d) selectively applying heat to the bottom of said package to seal said film wrapper to itself and to said layer of heat activated adhesive to from a package that is substantially leakproof.

6. A method in accordance with claim 5 wherein said tray is molded polyurethane.

7. A method in accordance with claim 6 wherein said film is polyvinylchloride.

8. A method in accordance with claim 7 wherein said adhesive tape is affixed to the bottom of said tray using a pressure-activated adhesive.

* * * * *